US012466678B2

(12) United States Patent
Iwata

(10) Patent No.: US 12,466,678 B2
(45) Date of Patent: Nov. 11, 2025

(54) SHEET CONVEYANCE APPARATUS AND IMAGE FORMING APPARATUS

(71) Applicant: CANON KABUSHIKI KAISHA, Tokyo (JP)

(72) Inventor: Toshiyuki Iwata, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 210 days.

(21) Appl. No.: 18/503,577

(22) Filed: Nov. 7, 2023

(65) Prior Publication Data

US 2024/0158193 A1 May 16, 2024

(30) Foreign Application Priority Data

Nov. 10, 2022 (JP) ..... 2022-180328

(51) Int. Cl.
*B65H 7/12* (2006.01)

(52) U.S. Cl.
CPC ..... *B65H 7/12* (2013.01); *B65H 2513/10* (2013.01); *B65H 2553/30* (2013.01)

(58) Field of Classification Search
CPC . B65H 5/06; B65H 5/062; B65H 7/02; B65H 7/06; B65H 7/12; B65H 2513/10; B65H 2553/30
See application file for complete search history.

(56) References Cited

U.S. PATENT DOCUMENTS

| | | | | |
|---|---|---|---|---|
| 5,273,269 | A * | 12/1993 | Iwanaga | B65H 7/12 271/124 |
| 6,234,470 | B1 * | 5/2001 | Okitsu | B65H 7/125 271/9.09 |
| 9,359,159 | B2 * | 6/2016 | Noda | B65H 7/14 |
| 10,065,819 | B2 * | 9/2018 | Shoji | G03G 15/6529 |
| 10,189,662 | B2 * | 1/2019 | Okano | B65H 7/125 |

FOREIGN PATENT DOCUMENTS

JP 2009292549 A 12/2009

* cited by examiner

*Primary Examiner* — Leslie A Nicholson, III
(74) *Attorney, Agent, or Firm* — ROSSI, KIMMS & McDOWELL LLP

(57) ABSTRACT

A sheet conveyance apparatus includes a sheet conveyance unit, a double feeding detection unit, a first sheet detection unit, and a control unit. The double feeding detection unit detects double feeding with respect to a sheet. The control unit controls a conveyance speed of a sheet conveyed by the sheet conveyance unit at a first speed and a second speed which is slower than the first speed and at which the sheet is in motion. The control unit controls the sheet conveyance unit to decelerate the conveyance speed of a sheet conveyed by the sheet conveyance unit from the first speed to the second speed based on a detection result of the first sheet detection unit. The control unit controls the double feeding detection unit to execute a double feeding detecting operation with respect to the sheet that is conveyed at the second speed by the sheet conveyance unit.

8 Claims, 12 Drawing Sheets

SHEET CONVEYANCE APPARATUS AND IMAGE FORMING APPARATUS

BACKGROUND OF THE INVENTION

Field of the Invention

This disclosure relates to a sheet conveyance apparatus conveying a sheet and an image forming apparatus to which this sheet conveyance apparatus is applied.

Description of the Related Art

Hitherto, in the field of commercial printing, various deliverables such as booklets and brochures are often output, and the deliverables themselves are often treated as commodities. If double feeding in which sheets in sheet feed cassettes cannot be separated and are conveyed in an overlapping state occurs, there is a possibility that the deliverables cannot be used as the deliverables since a blank sheet is mixed into the deliverables, and the redoing of the printing may occur. Therefore, so as to suppress the occurrence of the double feeding, in a case where images are formed by separating sheet bundles set inside of the sheet feed cassettes into one sheet at a time, configurations in which ultrasonic double feeding detection units that detect sheets conveyed in an unseparated and overlapping state are disposed are known (refer to Japanese Patent Laid Open No. 2009-292549). By disposing the double feeding detection units as described above, the printing is stopped in a case where the double feeding is detected, and the mixing of the double-feeding sheet into the deliverables is prevented.

A large number of these ultrasonic double feeding detection units that are built into the image forming apparatuses determine a threshold value by performing a measurement in a no-sheet state, and, thereafter, perform a measurement in a sheet-present state during sheet passing. Further, it is desirable that, so as to detect the double feeding not only in a state in which two sheets are completely overlapped but also in a state in which the two sheets are partially overlapped, a double feeding detecting operation is performed for a plurality of times for each sheet by varying detection positions in the sheet.

However, if, in the image forming apparatus described in Japanese Patent Laid Open No. 2009-292549, a sheet conveyance speed is increased so as to obtain high productivity, it becomes difficult to perform the double feeding detecting operation for the plurality of times for each sheet. While, so as to prioritize the execution of the plurality of times of the double feeding detecting operation, it is conceivable, after having performed the double feeding detecting operation of a first time, to perform the double feeding detecting operation of a second time by temporarily stopping the sheet synchronously with such as a stoppage for preregistration, the productivity is decreased in such a case. As described above, there are difficulties in realizing both of the productivity and the accuracy of the double feeding detection.

Purpose of this disclosure is to provide the sheet conveyance apparatus and the image forming apparatus that can realize both of the productivity and the accuracy of the double feeding detection.

SUMMARY OF THE INVENTION

According to a first aspect of the present invention, a sheet conveyance apparatus includes a sheet conveyance unit configured to convey a sheet, a double feeding detection unit configured to detect double feeding with respect to a sheet conveyed by the sheet conveyance unit, a first sheet detection unit configured to detect a sheet conveyed by the sheet conveyance unit, and a control unit configured to control a conveyance speed of a sheet conveyed by the sheet conveyance unit at a first speed and a second speed which is slower than the first speed and at which the sheet is in motion. The control unit is configured to control the sheet conveyance unit to decelerate the conveyance speed of a sheet conveyed by the sheet conveyance unit from the first speed to the second speed based on a detection result of the first sheet detection unit, and control the double feeding detection unit to execute a double feeding detecting operation with respect to the sheet that is conveyed at the second speed by the sheet conveyance unit.

According to a second aspect of the present invention, an image forming apparatus includes the sheet conveyance apparatus, and an image forming unit configured to form an image on a sheet conveyed by the sheet conveyance apparatus.

Further features of the present invention will become apparent from the following description of exemplary embodiments with reference to the attached drawings.

DESCRIPTION OF THE EMBODIMENTS

Figure 1:
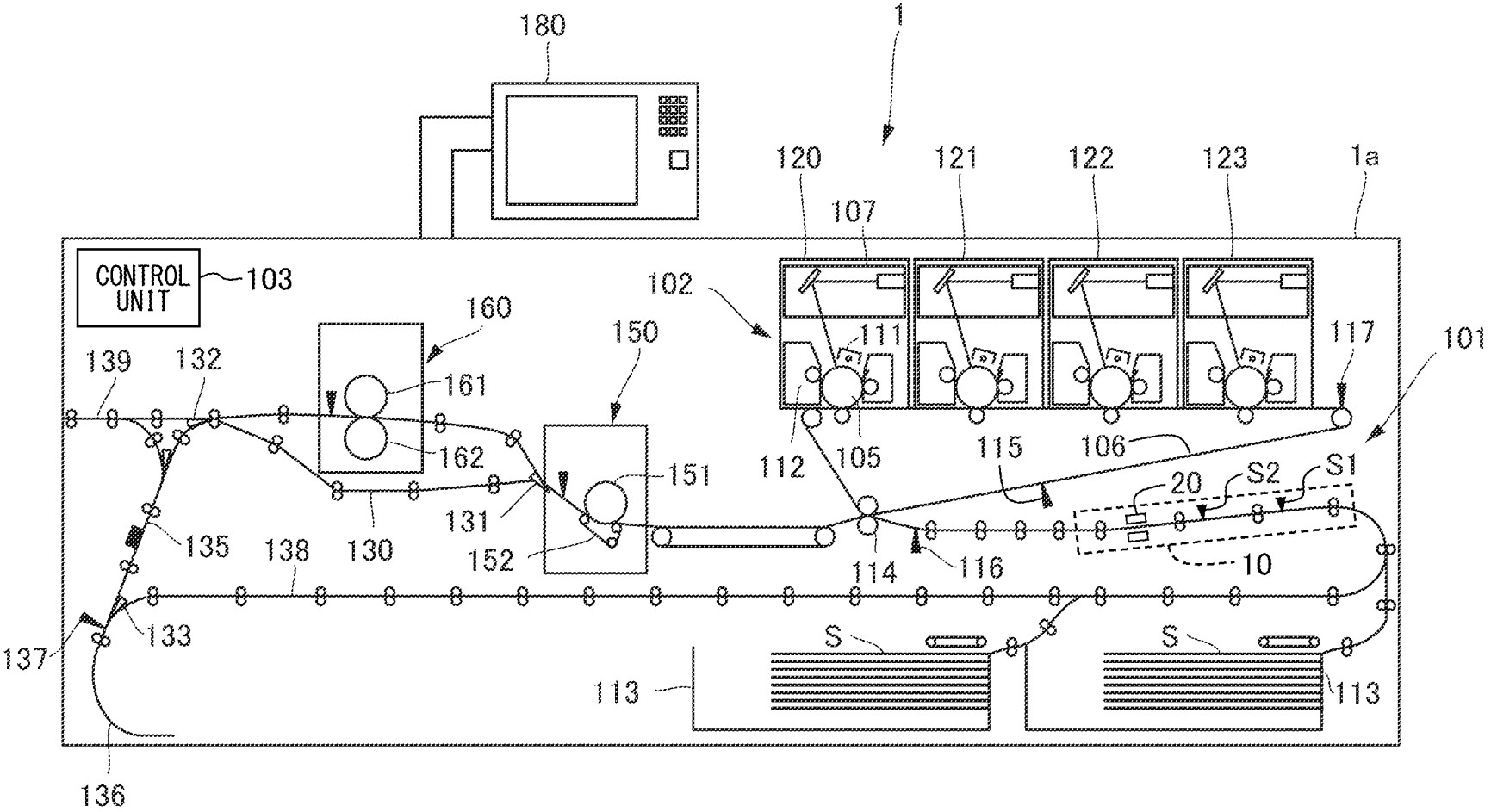
FIG. 1 is a cross-sectional view illustrating an image forming apparatus of an embodiment.

Hereinafter, the present embodiment will be described using diagrams. First, a schematic configuration of an image forming apparatus 1 of the present embodiment will be described using FIG. 1. FIG. 1 is a cross-sectional view illustrating the image forming apparatus 1 of the present embodiment. To be noted, as the present embodiment, a full color copier including a plurality of photosensitive drums is applied. However, it is not limited to this, and the present embodiment can be also applied to a mono-color copier and printer including one photosensitive drum.

Image Forming Apparatus

The image forming apparatus 1 conveys a sheet S conveyed from a sheet cassette 113 to an image forming unit, and forms a toner image on the sheet S. The image forming unit 1 conveys the sheet S, on which the toner image has been formed in the image forming unit 102, to fixing units 150 and 160, and fixes unfixed toner on the sheet S by applying heat and pressure. As the sheet S, paper such as thin paper and cardboard, a plastic film such as a sheet for an overhead projector (OHP), surface treated paper such as coated paper, a specially shaped sheet such as an envelope, and cloth are included.

The image forming unit 102 includes stations 120, 121, 122, and 123, and forms an image on the sheet conveyed by a sheet conveyance unit 10. The image forming apparatus 1 includes an intermediate transfer belt 106 and a secondary transfer outer roller 114. The stations 120, 121, 122, and 123 respectively form the toner images of yellow, magenta, cyan, and black on the intermediate transfer belt 106. Configurations are common to the stations 120, 121, 122, and 123 except for differences in colors of toners. Therefore, herein, the configuration of the station 120 will be described as an example, and descriptions of the configurations of the other stations 121, 122, and 123 will be omitted.

A photosensitive drum 105, serving as an image bearing member, rotates in a counter-clockwise direction in FIG. 1. A primary charge unit 111 charges a surface of the photosensitive drum 105 to a uniform surface potential. A laser unit 108 includes a light source that outputs a laser beam, and forms an electrostatic latent image on the photosensitive drum 105. A developing unit 112 develops the electrostatic latent image formed on the photosensitive drum 105 using developer containing the toner, and forms the toner image. The toner images formed by the stations 120, 121, 122, and 123 are transferred onto the intermediate transfer belt 106. The secondary transfer outer roller 114 transfers the toner image on the intermediate transfer belt 106 onto the sheet S conveyed from the sheet cassette 113.

On the other hand, the sheet S fed from the sheet cassette 113 is conveyed to the secondary transfer outer roller 114 via the sheet conveyance unit 10. In the secondary transfer outer roller 114, in conjunction with bringing the sheet S into pressure contact with the intermediate transfer belt 106, a bias voltage of an opposite polarity to the toner is applied to the secondary transfer outer roller 114. Thereby, a visible image that is formed on the intermediate transfer belt 106 is secondarily transferred onto the sheet S fed synchronously in a sub-scanning direction by a sheet feed processing mechanism. A starting position detection sensor 115 for determining a printing start position at a time of image formation, a sheet feed timing sensor 116 for measuring a timing for feeding the sheet S, and a density sensor 117 for measuring a patch density at a time of density control are arranged around the intermediate transfer belt 106. When the density control is performed, the density sensor 117 measures the density of each patch.

The image forming apparatus 1 includes the first and second fixing units 150 and 160 for fixing the toner image transferred onto the sheet S by the heat and pressure. The first fixing unit 150 includes a fixing roller 151 for applying the heat to the sheet S, a pressing belt 152 for bringing the sheet S into pressure contact with the fixing roller 151, and a post-fixing sensor 153 for detecting the completion of the fixing. The fixing roller 151 is a hollow roller, and includes a heater inside. The fixing roller 151 conveys the sheet S while being rotatably driven. The second fixing unit 160 is positioned downstream of the first fixing unit 150 in a conveyance path of the sheet S, and is arranged for purposes of such as applying gloss and ensuring fixability to the toner image fixed on the sheet S by the first fixing unit 150. As with the first fixing unit 150, the second fixing unit 160 includes a fixing roller 161, a pressing roller 162, and a post-fixing sensor 163.

Depending on a type of the sheet S, the sheet S includes a sheet that does not need to pass through the second fixing unit 160. For a purpose of reducing energy consumption in such a case, the image forming apparatus 1 includes a conveyance path 130 for discharging the sheet S without passing through the second fixing unit 160. It is possible to guide the sheet S to the conveyance path 130 by a switching member 131.

A switching member 132 serves to guide the sheet S, which has been conveyed via the image forming unit 102 and fixing units 150 and 160, either outside of the image forming apparatus 1 or to a conveyance path 135. In a case of single-sided printing, after the image formation has been completed by passing through the image forming unit 102 and the fixing units 150 and 160, the sheet S is guided to a sheet discharge path 139 by the switching member 132, and discharged outside.

In a case of duplex printing, the sheet S on whose one side the image formation has been completed is reversed, and conveyed to the image forming unit 102. In particular, the sheet S is guided to the conveyance path 135 by the switching member 132 after the fixing, and conveyed to a reverse portion 136. When a reverse sensor 137 detects a trailing edge of the sheet S, a switching member 133 switches the conveyance direction of the sheet S to a conveyance path 138. The sheet S that has been reversed is conveyed to the image forming unit 102 again via the conveyance path 138, and conveyed further to the fixing units 150 and 160. When the duplex printing has been completed, the sheet S is guided to the sheet discharge path 139 by the switching member 132, and discharged outside.

To be noted, in the present embodiment, a sheet conveyance apparatus 101 includes the sheet conveyance unit 10, a first sensor S1, a double feeding detection unit 20, and a control unit 103. Further, a skew correction apparatus is disposed between the sheet conveyance unit 10 and the secondary transfer outer roller 114.

Figure 2:
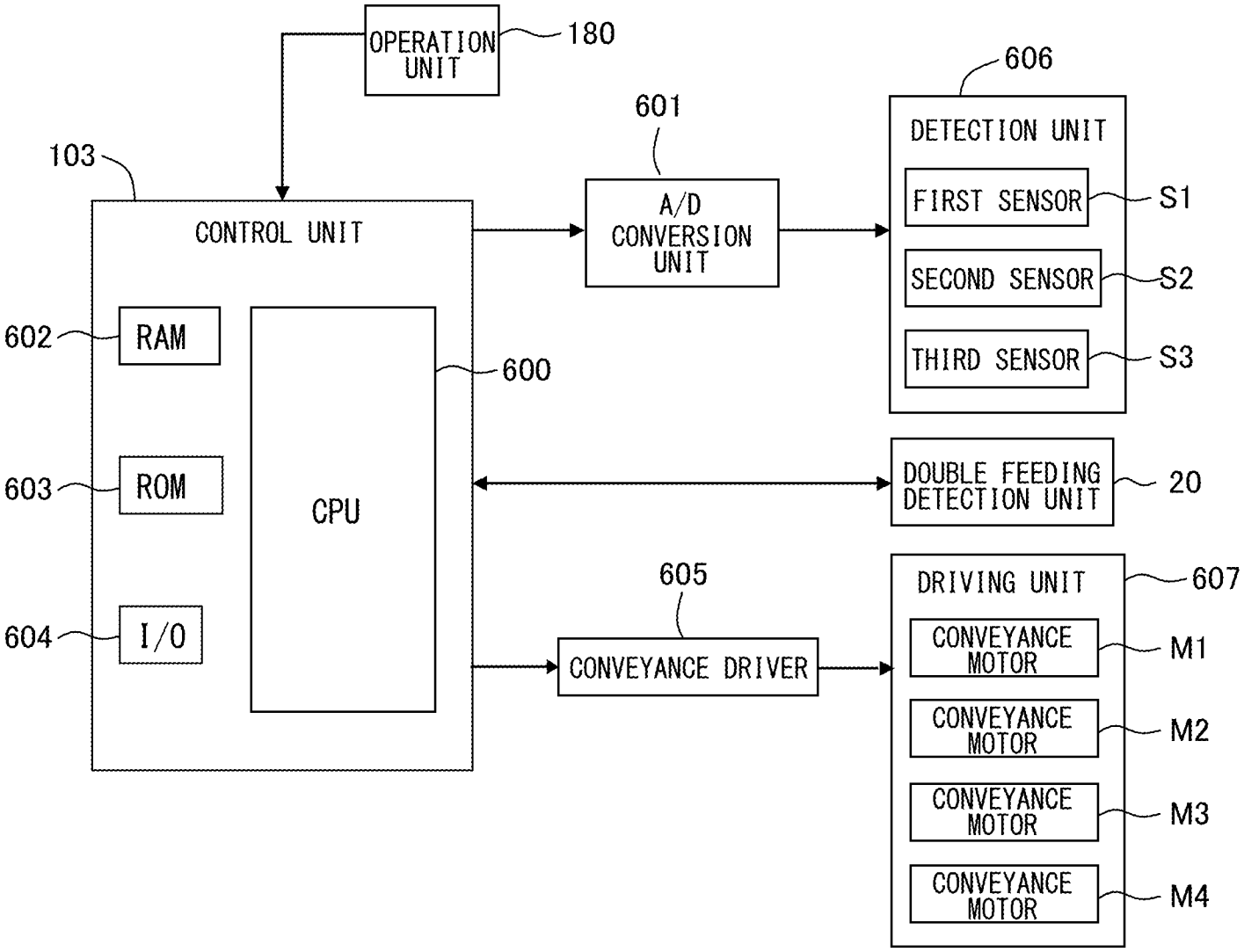
FIG. 2 is a block diagram illustrating a control system of the image forming apparatus of the embodiment.

Next, a control system of the image forming apparatus 1 will be described using FIG. 2. As illustrated in FIG. 2, the control unit 103 includes a central processing unit (CPU) 600, a random access memory (RAM) 602, a read only memory (ROM) 603, and an input/output (I/O) 604, and controls each unit described above incorporated in the image forming apparatus 1. Based on a detection signal that is input from each of sensors and information that is stored in the ROM 603, the CPU 600 outputs output signals to each of electrical components so as to operate the electrical components at a desired timing and a necessary control amount. Therefore, this CPU 600 is the one that in fact controls the electrical components. The ROM 603 and the RAM 602 store information data required for the control of each unit, and the CPU 600 reads the information data stored in the ROM 603 and writes to the RAM 602.

An operation unit 180 includes a display screen and selection keys. The operation unit 180 displays information output from the control unit 103 on the display screen, and, by receiving operation instructions from a user by the selection keys, inputs the operation instructions into the control unit 103. Through the operation unit 180, an operation mode of the image forming apparatus 1 and information of a passing sheet are set by the user. The CPU 600 executes various control programs stored in the ROM 603 based on that setting, and performs the control of a driving unit 607 based on an input signal of a detection unit 606, which is digitally converted at an analog/digital (A/D) conversion unit 601, via a conveyance driver 605. The detection unit 606 includes the first sensor S1, a second sensor S2, and a third sensor S3, and the driving unit 607 includes conveyance motors M1 to M4. The first, second, and third sensors S1, S2, and S3 are, for example, constituted from a light sensor, and, in a contactless manner, can detect whether or not the sheet is present in a detection area of each sensor. The first sensor S1 is an example of a first sheet detection unit, and detects the sheet that is conveyed by the conveyance unit 10. The second sensor S2 is an example of a second sheet detection unit, and detects the sheet that is conveyed by the conveyance unit 10.

Sheet Conveyance Unit

Figure 3:
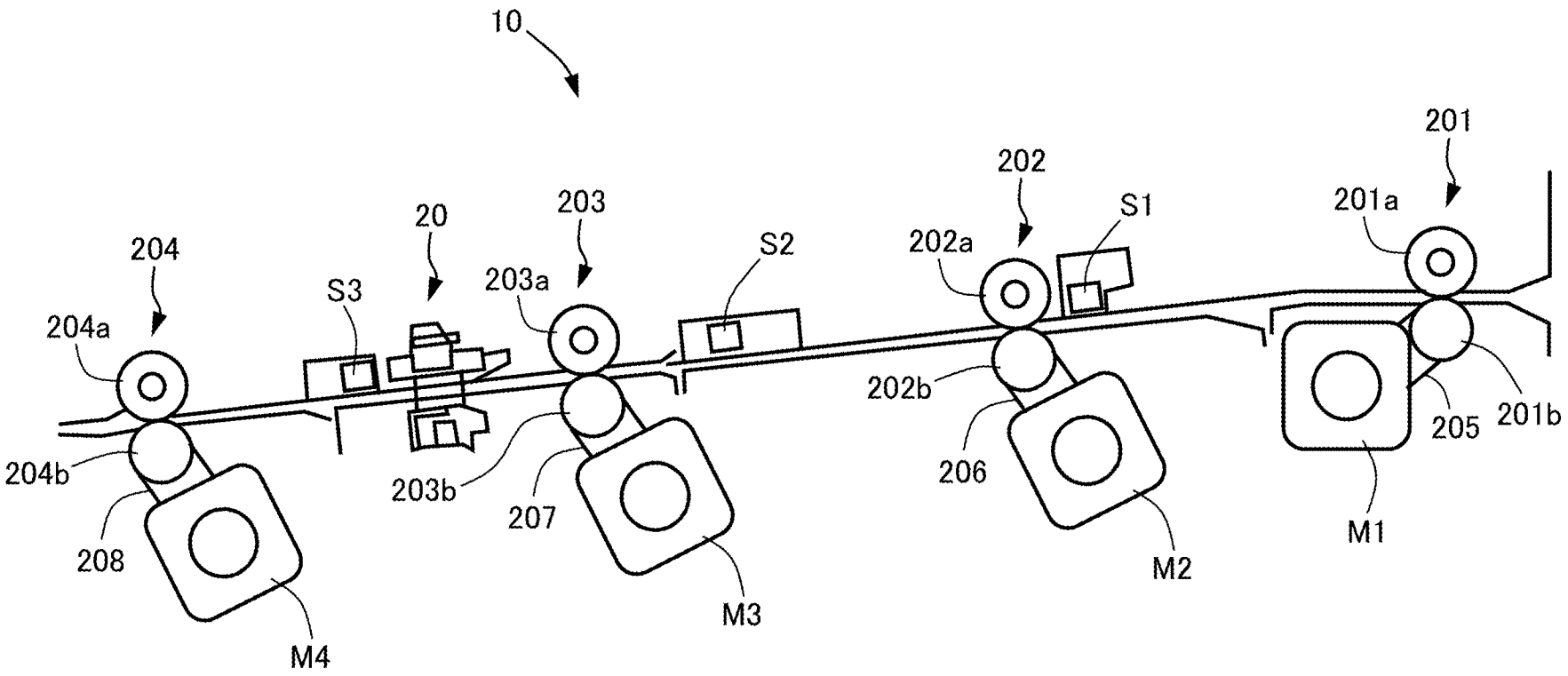
FIG. 3 is a cross-sectional view illustrating a sheet conveyance unit of the embodiment.
Figure 4:
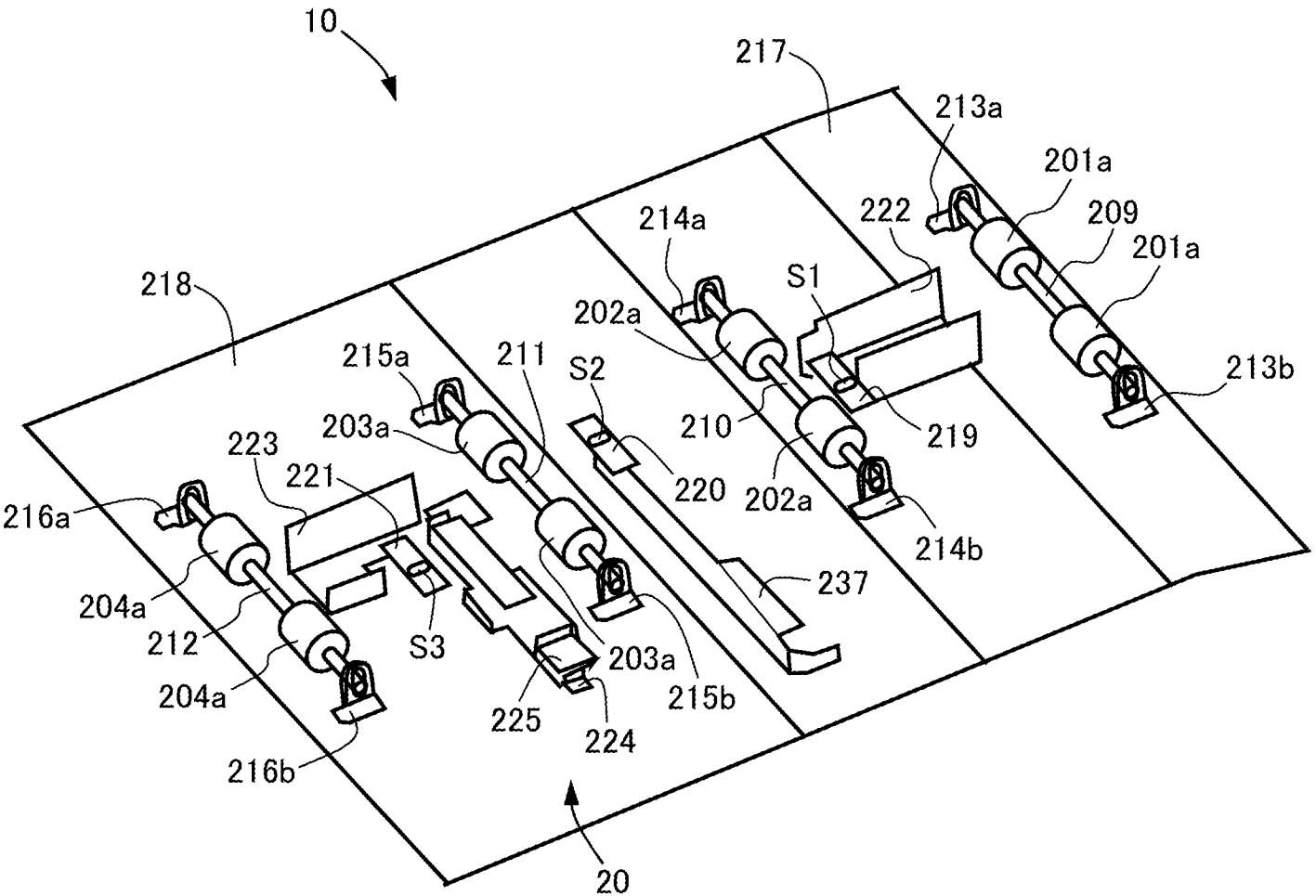
FIG. 4 is a perspective view illustrating the sheet conveyance unit of the embodiment.
Figure 5:
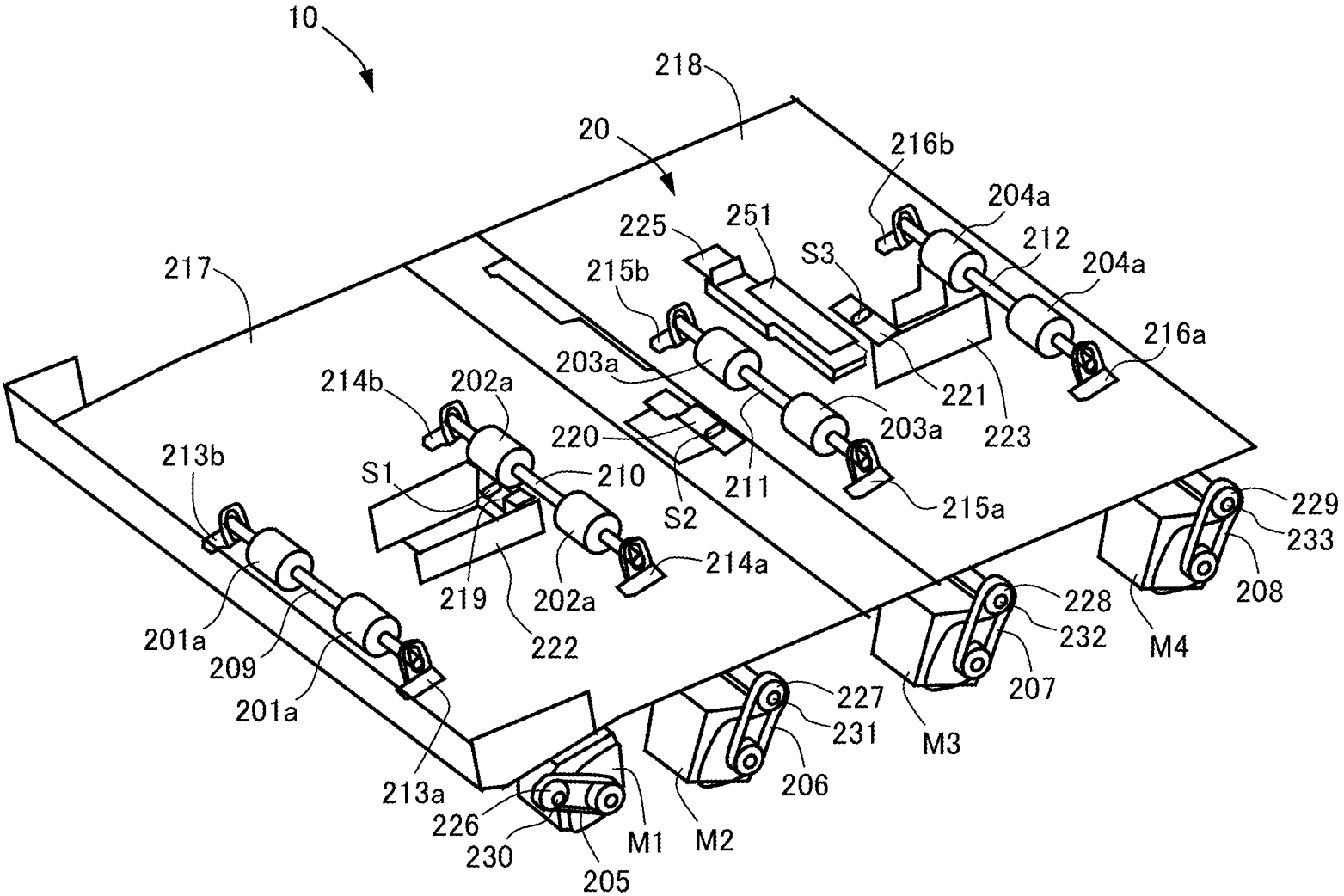
FIG. 5 is a perspective view illustrating the sheet conveyance unit of the embodiment when viewed in a direction different from a direction viewed in FIG. 4.
Figure 6:
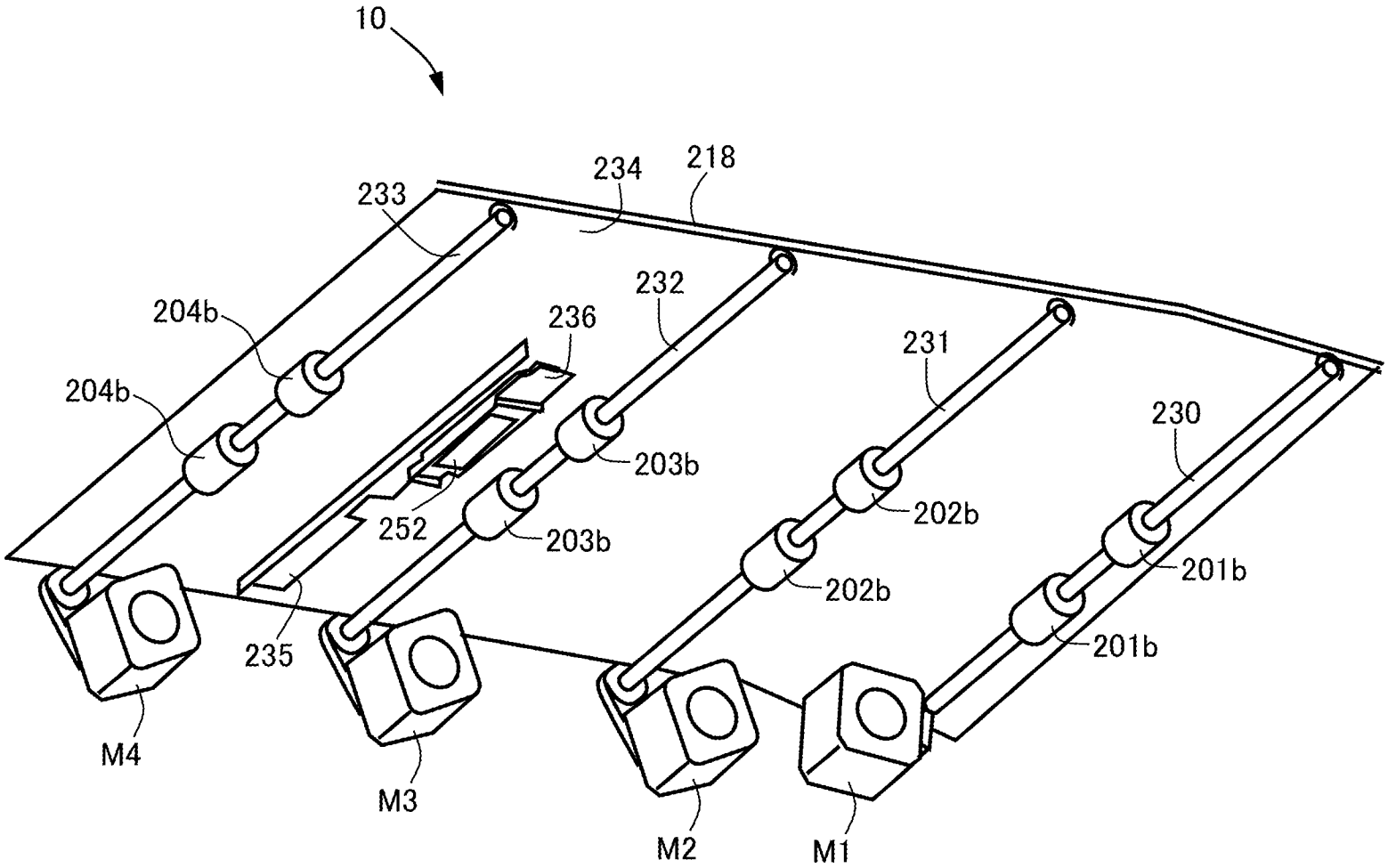
FIG. 6 is a perspective view illustrating the sheet conveyance unit of the embodiment when viewed from below.
Figure 7A:
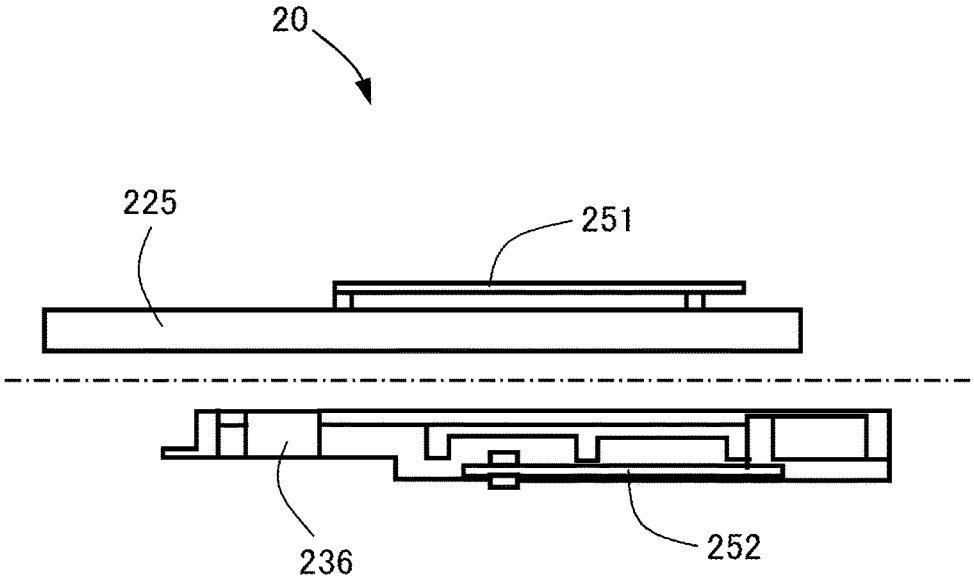
FIG. 7A is a cross-sectional view illustrating a double feeding detection unit of the embodiment.
Figure 7B:
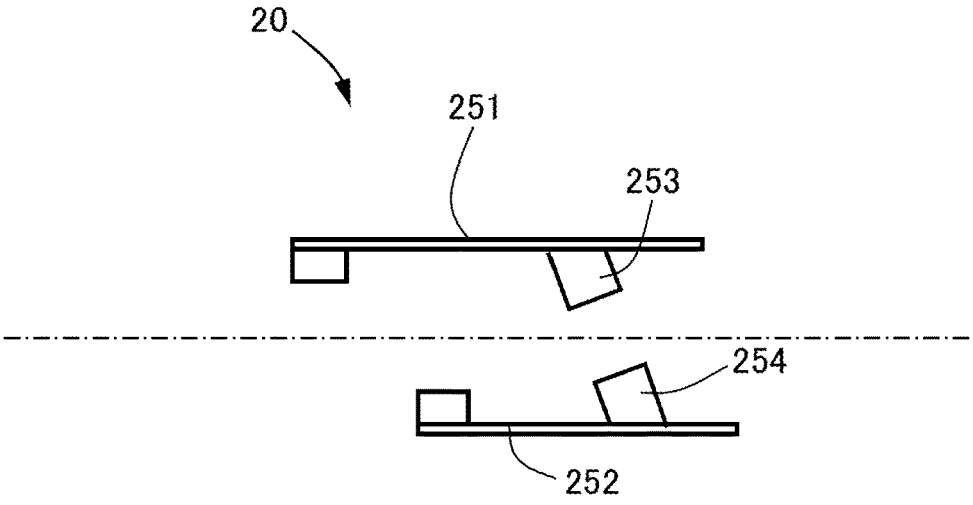
FIG. 7B is a cross-sectional view illustrating sensor portions of the double feeding detection unit of the embodiment.

Next, using FIGS. 3 to 7B, the sheet conveyance unit 10 of the present embodiment will be described. FIG. 3 is a cross-sectional view illustrating the sheet conveyance unit 10 that is an example of a sheet conveyance unit, FIGS. 4 to 6 are perspective views illustrating the sheet conveyance unit 10, and FIGS. 7A and 7B are side views illustrating a double feeding detection unit. As illustrated in FIG. 3, the sheet conveyance unit 10 includes such as first, second, third, and fourth conveyance roller pairs 201, 202, 203, and 204 that convey the sheet fed from the sheet cassette 113, and the double feeding detection unit 20. Further, the first, second, and third sensors S1, S2, and S3 that detect the sheet are disposed inside of the conveyance path, and the third sensor S3 is disposed downstream of the double feeding detection unit 20 in a sheet conveyance direction. The first, second, and third sensors S1, S2, and S3 are used for the control of a timing of a double feeding detection by the double feeding detection unit 20 and the control of a timing of a shift in a conveyance speed of the sheet S conveyed by the sheet conveyance unit 10.

The first conveyance roller pair 201 includes a drive roller 201*b* and a driven roller 201*a*, and the second conveyance roller pair 202 includes a drive roller 202*b* and a driven roller 202*a*. The third conveyance roller pair 203 includes a drive roller 203*b* and a driven roller 203*a*, and the fourth conveyance roller pair 204 includes a drive roller 204*b* and a driven roller 204*a*. It is noted that the rollers 201*a*, 201*b*, 202*a*, 202*b*, 203*a*, 203*b*, 204*a*, and 204*b* include two rollers separated in a width direction intersected with the sheet conveyance direction respectively.

As illustrated in FIGS. 4 to 6, the first to fourth conveyance roller pairs 201 to 204 that convey the sheet fed from the sheet cassette 113 are disposed in the sheet conveyance unit 10. In order from the upstream side, the sheet is conveyed by the first, second, third, and fourth conveyance roller pairs 201, 202, 203, and 204.

A roller shaft 209 is connected to the driven roller 201*a* of the first conveyance roller pair 201, and supported by roller shaft support portions 213*a* and 213*b* swaged to a conveyance guide 217. The first sensor S1 is disposed downstream of the first conveyance roller pair 201 in the sheet conveyance direction, and mounted to a sensor pedestal 219 connected to a sensor support member 222 swaged to the conveyance guide 217. That is, the first sensor S1 is disposed further upstream than the double feeding detection unit 20 in the sheet conveyance direction. A roller shaft 210 is connected to the driven roller 202*a* of the second conveyance roller pair 202, and supported by roller shaft support portions 214*a* and 214*b* swaged to the conveyance guide 217. The second sensor S2 is disposed downstream of the second conveyance roller pair 202 in the sheet conveyance direction, and mounted to a sensor pedestal 220 connected to a sensor support member 237 swaged to the conveyance guide 217. That is, in the sheet conveyance direction, the second sensor S2 is disposed further upstream than the double feeding detection unit 20 and further downstream than the first sensor S1.

A roller shaft 211 is connected to the driven roller 203*a* of the third conveyance roller pair 203, and supported by roller shaft support portions 215*a* and 215*b* swaged to a conveyance guide 218. The third sensor S3 is disposed downstream of the third conveyance roller pair 203 in the sheet conveyance direction, and mounted to a sensor pedestal 221 connected to a sensor support member 223 swaged to the conveyance guide 218. A roller shaft 212 is connected to the driven roller 204*a* of the fourth conveyance roller pair 204, and supported by roller shaft support portions 216*a* and 216*b* swaged to the conveyance guide 218.

As illustrated in FIG. 6, a drive shaft 230 is connected to the drive roller 201*b* of the first conveyance roller pair 201, and, as illustrated in FIG. 5, a drive pulley 226 is attached to the drive shaft 230. The drive pulley 226 is coupled to a drive shaft of a conveyance motor M1 by a timing belt 205. A drive shaft 231 is connected to the drive roller 202*b* of the second conveyance roller pair 202, and a drive pulley 227 is attached to the drive shaft 231. The drive pulley 227 is coupled to a drive shaft of a conveyance motor M2 by a timing belt 206. A drive shaft 232 is connected to the drive roller 203*b* of the third conveyance roller pair 203, and a drive pulley 228 is attached to the drive shaft 232. The drive pulley 228 is coupled to a drive shaft of a conveyance motor M3 by a timing belt 207. A drive shaft 233 is connected to the drive roller 204*b* of the fourth conveyance roller pair 204, and a drive pulley 229 is attached to the drive shaft 233. The drive pulley 229 is coupled to a drive shaft of a conveyance motor M4 by a timing belt 208. Since, as described above, the first to fourth conveyance roller pairs 201 to 204 each are independently driven by the respective conveyance motors M1 to M4, conveyance speeds of the first to fourth conveyance roller pairs 201 to 204 can be set individually.

Double Feeding Detection Unit

The double feeding detection unit 20 detects double feeding with respect to the sheet conveyed by the sheet conveyance unit 10. As illustrated in FIG. 7A, the double feeding detection unit 20 includes a receiving board 251 disposed on an upper side of the conveyance path and an oscillating board 252 disposed on a lower side. The receiving board 251 is supported by a board pedestal 225 mounted to the sensor support member 223 (refer to FIG. 4), and the oscillating board 252 is supported by a board pedestal 236 mounted to a support member 235 disposed on a conveyance guide 234 (refer to FIG. 6). As illustrated in FIG. 7B, a receiving portion 253 is disposed on the receiving board 251, and an oscillating portion 254 is disposed on the oscillating board 252. The oscillating and receiving portions 254 and 253 are sensors that can detect the thickness of an object by emitting and receiving an ultrasonic wave, and are disposed in a manner facing each other at a predetermined angle with respect to a vertical direction.

By the oscillating and receiving boards 251 and 252, the double feeding detecting unit 20 performs no-sheet detection once and sheet-present detection twice for each page, and acquires one set of no-sheet data and two sets of sheet-present data. In the present embodiment, when performing the sheet-present detection twice, it takes about 140 milliseconds (ms) as a processing time. Based on the acquired no-sheet data, a threshold value used for a judgement of the double feeding or single feeding is calculated, and, by comparing the calculated threshold value with the sheet-present data, whether it is the double feeding or the single feeding is judged. Here, since the determination of the double or single feeding is relatively time consuming, there is a possibility of hindering improvement in productivity if, for example, the sheet is stopped or conveyed at a low speed. On the other hand, if, by giving priority to the productivity, a time for the double feeding detection is shortened more than necessary, the accuracy of the double feeding detection is decreased. Therefore, in the present embodiment, when the sheet-present detection is performed, the sheet is conveyed at a low speed so as to reliably detect the double feeding. On the other hand, until the sheet-present detection is performed, the productivity is increased by conveying the sheet at a high speed. Thereby, both of the accuracy of the double feeding detection and the productivity are realized in the present embodiment. To be noted, while descriptions of the detailed control of the double feeding detection unit 20 will be omitted herein, a CPU circuit, not shown, is disposed on the receiving board 251, and communicates with the CPU 600 included in the control unit 103 so as to determine a timing of the double feeding detection and the occurrence of the double feeding.

Sheet Conveyance Control

Figure 8:
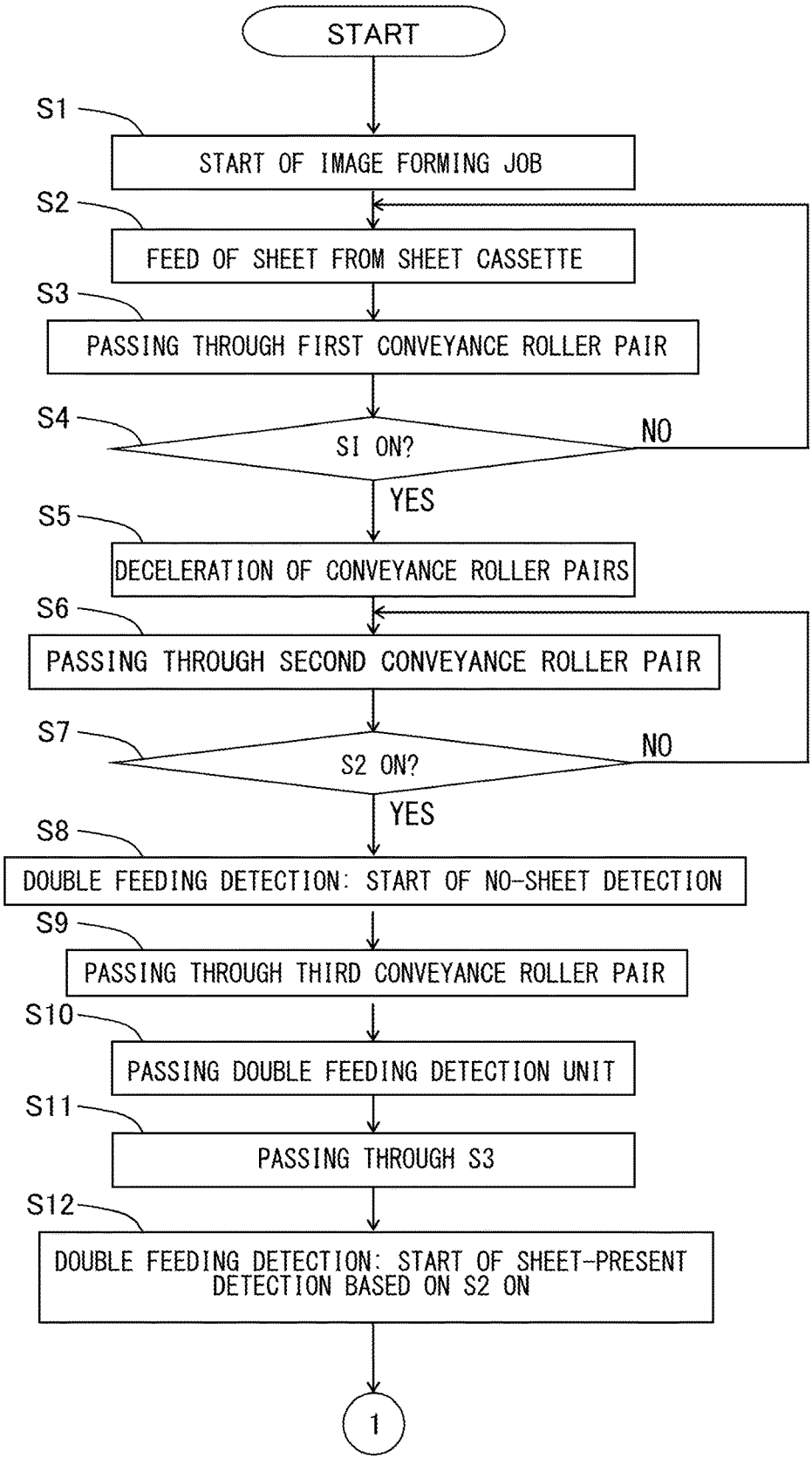
FIG. 8 is a flowchart illustrating a first half of processing steps of the double feeding detecting operation in the image forming apparatus of the embodiment.
Figure 9:
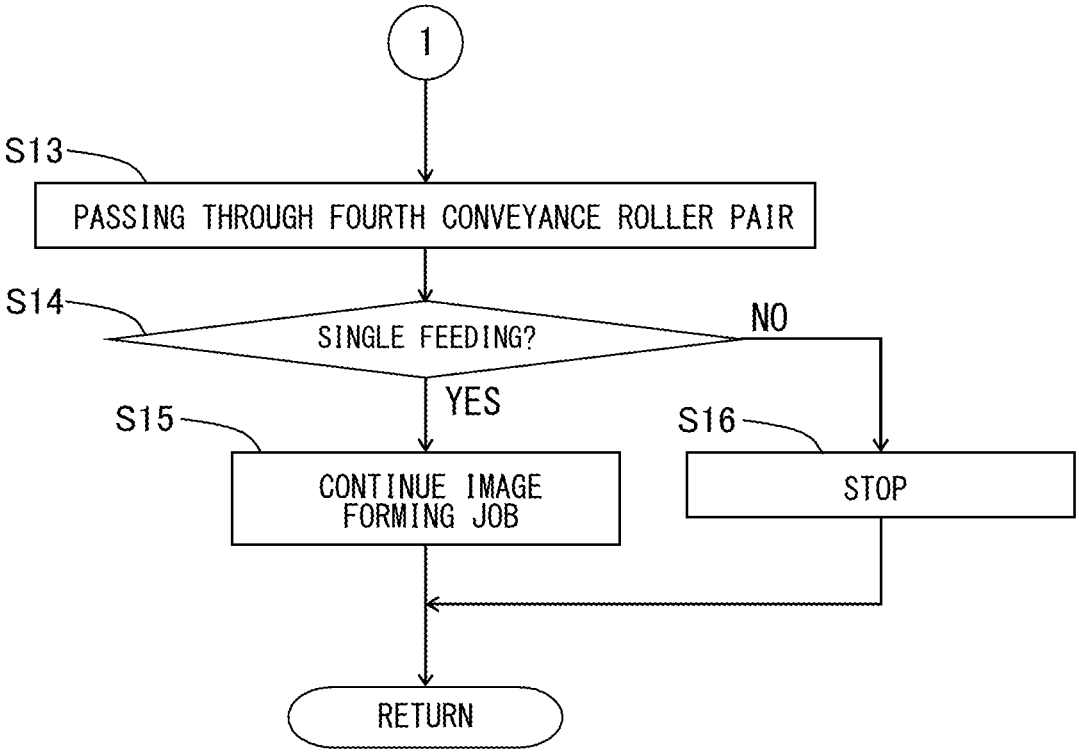
FIG. 9 is a flowchart illustrating a latter half of the processing steps of the double feeding detecting operation in the image forming apparatus of the embodiment.
Figure 10:
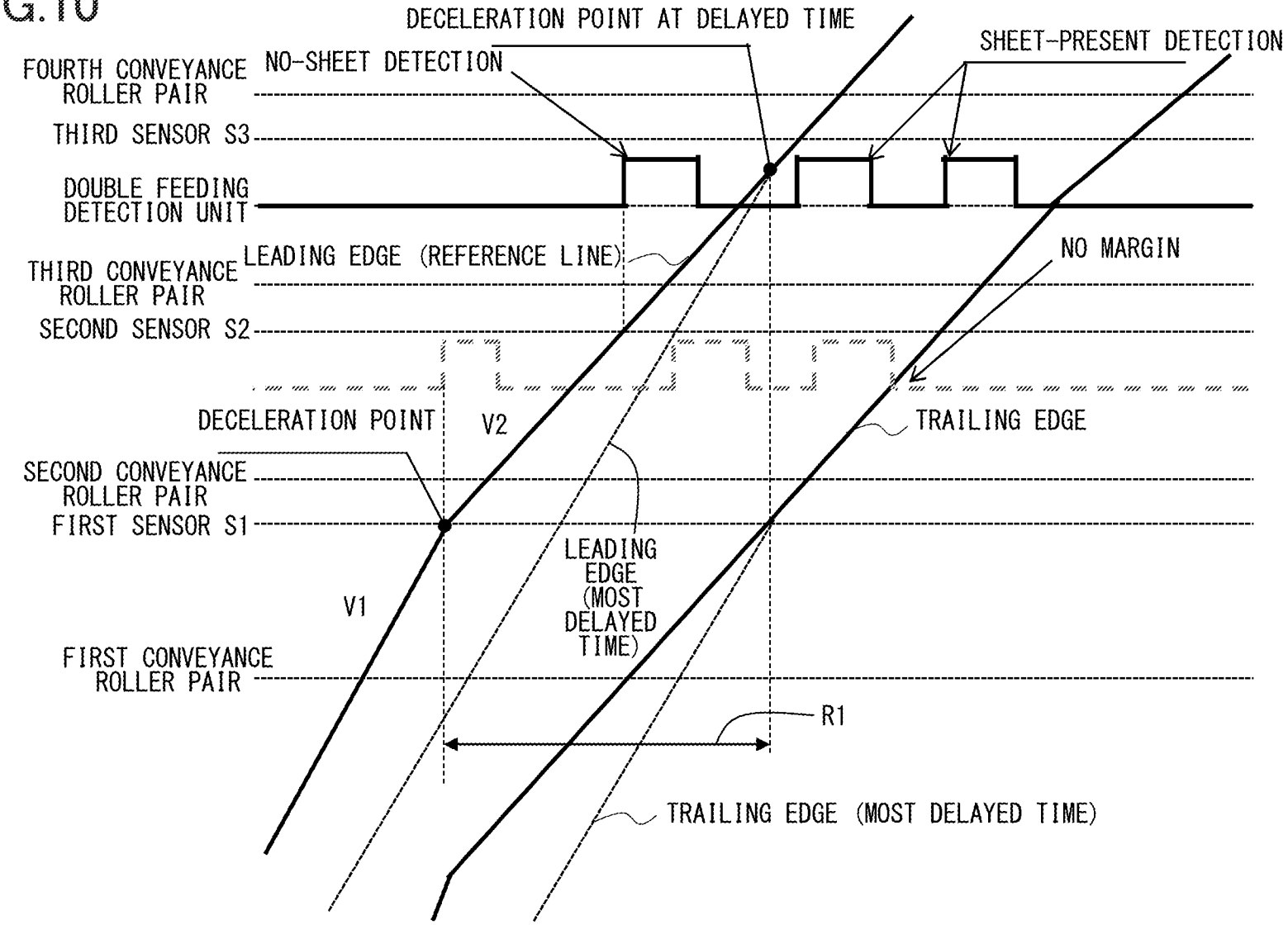
FIG. 10 is a time chart illustrating the processing of the double feeding detecting operation in the image forming apparatus of the embodiment.
Figure 11:
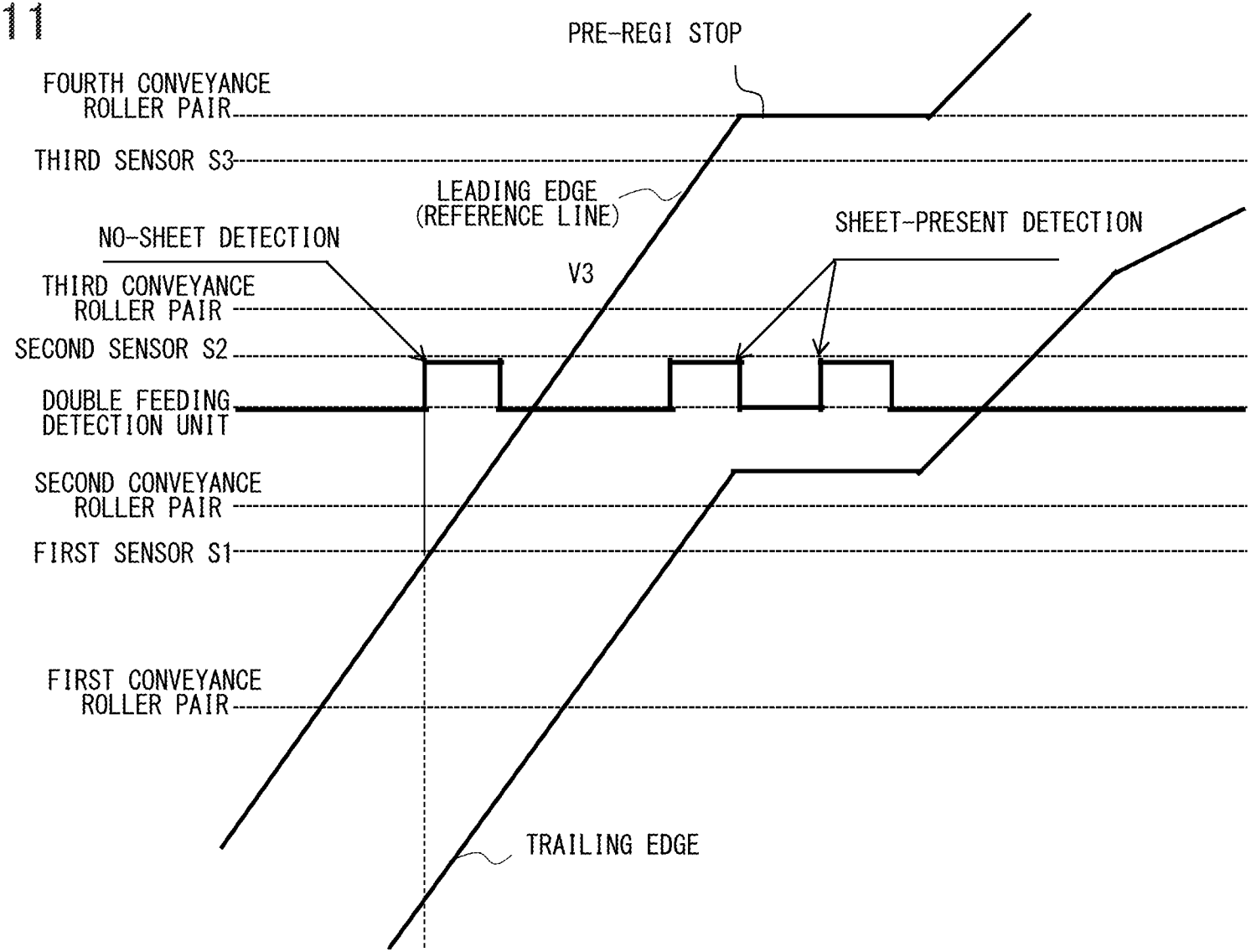
FIG. 11 is a time chart illustrating the processing of a double feeding detecting operation in an image forming apparatus of a comparative example.

Next, a flow of the sheet conveyance using the sheet conveyance unit 10 of the present embodiment will be described based on FIGS. 8 to 10. FIGS. 8 and 9 are flow charts illustrating the flow of the sheet conveyance. FIG. 10 is a time chart illustrating a conveyance diagram of the sheet conveyance unit 10 and a double feeding detection timing of the double feeding detection unit 20, and FIG. 11 is a time chart illustrating a conveyance diagram and a double feeding detection timing of a comparative example.

First, processing steps of the sheet conveyance using the sheet conveyance unit 10 of the present embodiment will be described along the flowcharts illustrated in FIGS. 8 and 9. When an image forming job is started upon setting of the job onto the operation unit 180 by the user (STEP S1), the sheet S is fed from the sheet cassette 113 (STEP S2), and is conveyed to the sheet conveyance unit 10. When a leading edge of the sheet S has passed through the first conveyance roller pair 201 (STEP S3), the control unit 103 judges whether or not the first sensor S1 has been turned on (STEP S4). In a case where the control unit 103 has judged that the first sensor S1 was not turned on (STEP S4: NO), the sheet S is fed from the sheet cassette 113 again (STEP S2).

In a case where the control unit 103 has judged that the first sensor S1 was turned on (STEP S4: YES), the control unit 103 decelerates the first to fourth conveyance roller pairs 201 to 204 (STEP S5). In the present embodiment, the conveyance speed before the sheet has reached the first sensor S1 is, as an example, a first speed V1 that is equal to 1300 millimeters per second (mm/s), and a conveyance speed after the deceleration is, as an example, set to a second speed V2 that is equal to 800 mm/s. That is, the control unit 103 controls the conveyance speed of the sheet S conveyed by the sheet conveyance unit 10 at the first speed V1 and the second speed V2 that is slower than the first speed V1 and not a speed at a standstill. Thereby, a speed setting is optimized such that, while realizing the high productivity by conveying the sheet S at a sufficiently high speed before the sheet S has reached the first sensor S1, when the double feeding detection of the sheet is performed, the double feeding detection can be performed highly accurately.

The sheet S is continuously conveyed with the first to fourth conveyance roller pairs 201 to 204 decelerated to the second speed V2, and passed through the second conveyance roller pair 202 (STEP S6). Thereafter, the control unit 103 judges whether or not the leading edge of the sheet S has reached the second sensor S2 and if the second sensor S2 has been turned on (STEP S7). In a case where the control unit 103 has judged that the second sensor S2 was not turned on (STEP S7: NO), the control unit 103 continues to convey the sheet S with the first to fourth conveyance roller pairs 201 to 204 decelerated to the second speed V2, and passes the sheet S through the second conveyance roller pair 202 (STEP S6).

In a case where the control unit 103 has judged that the second sensor S2 was turned on (STEP S7: YES), the control unit 103 starts the no-sheet detection by the double feeding detection unit 20 (STEP S8). That is, the control unit 103 acquires a detection result in a no-sheet state by the double feeding detection unit 20 before the sheet has reached the double feeding detection unit 20. The receiving board 251 of the double feeding detection unit 20 includes a slave CPU, not shown. At this time, the slave CPU performs such as the generation of an ultrasonic oscillation signal (burst wave) and the A/D conversion of a reception signal, and transmits a detected value acquired in the no-sheet state to the CPU 600 incorporated in the control unit 103. Thereafter, the sheet passes through the third conveyance roller pair 203 (STEP S9), and reaches the double feeding detection unit 20 (STEP S10) by being conveyed. Then, the sheet S reaches the third sensor S3 disposed downstream of the double feeding detection unit 20 in the sheet conveyance direction (STEP S11).

Figure 12A:
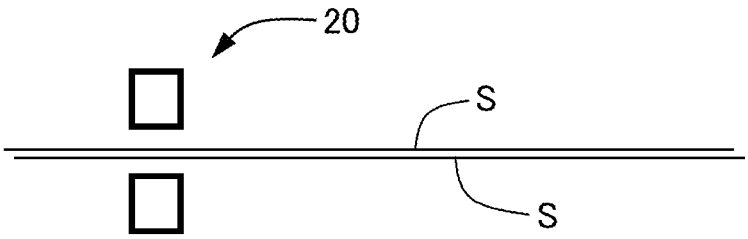
FIG. 12A is a side view illustrating a state of double feeding in a completely overlapped case.
Figure 12B:
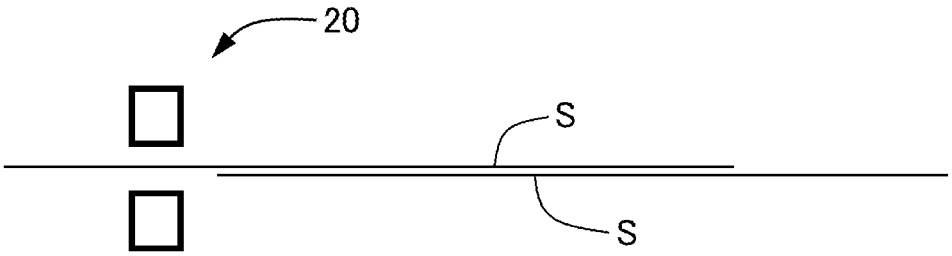
FIG. 12B is a side view illustrating a state of the double feeding in a partially overlapped case.

When a predetermined time has passed after the sheet S reached the second sensor S2, the double feeding detection unit 20 starts the detection in a sheet-present state upon receiving a signal from the CPU 600. In the sheet-present detection, the detection of not only a completely double feeding state (refer to FIG. 12A), in which two sheets of the sheet S are fully overlapped, but also a partially double feeding state (refer to FIG. 12B), in which the two sheets are separated up through the middle of the sheets, is enabled. Therefore, in the sheet-present detection, the double feeding detection unit 20 is controlled so as to perform the detection processing for a plurality of times, twice in the present embodiment. To be noted, depending on conditions, it is acceptable to perform the detection processing continuously for a long time only once.

As with the no-sheet detection, the CPU of the double feeding detection unit 20A/D converts the reception signal that has been read, and transmits the detected value of the sheet-present detection to the CPU 600 incorporated in the control unit 103 (STEP S12). That is, based on the detection result of the second sensor S2, the control unit 103 performs the double feeding detecting operation using the double feeding detection unit 20 with respect to the sheet. Based on the results of the no-sheet detection and the sheet-present detection, the CPU 600 determines whether the sheet is conveyed in either the double feeding or the single feeding. During that time, the sheet S is conveyed without being stopped, and passed through the fourth conveyance roller pair 204 (STEP S13). The control unit 103 determines (STEP S14) whether or not the sheet is conveyed in the single feeding, and, in a case where the control unit 103 has judged that the sheet is conveyed in the single feeding (STEP S14: YES), the image forming job is continued (STEP S15). In a case where the control unit 103 has judged that the sheet is not conveyed in the single feeding (STEP S14: NO), the control unit 103 stops the image forming job because of jam, and controls to stop the sheet conveyance so as not to convey the double feeding sheet downstream.

As described above, in the present embodiment, based on the detection result of the first sensor S1, the control unit 103 decelerates the sheet conveyance speed from the first speed V1 to the second speed V2 by the sheet conveyance unit 10. Then, the control unit 103 performs the double feeding detecting operation using the double feeding detection unit 20 with respect to the sheet that is conveyed at the second speed V2 by the sheet conveyance unit 10. The control unit 103 performs the double feeding detecting operation using the double feeding detection unit 20 for the plurality of times, twice in the present embodiment, for a single sheet.

Next, the sheet conveyance control of the present embodiment will be described in comparison with the sheet conveyance control of a comparative example. Graphs in FIGS. 10 and 11 respectively illustrate the sheet conveyance control of the present embodiment and the comparative example, and a vertical axis, a horizontal axis, and an inclination in the graphs respectively indicate a distance, an elapsed time, and a conveyance speed. In FIGS. 10 and 11, solid lines indicate diagrams illustrating the leading edge and a trailing edge of the sheet of a reference line. Further, in FIG. 10, dotted lines indicate diagrams illustrating the leading edge and the trailing edge of the sheet in the most delayed timing taking into consideration a decrease in conveyance efficiency due to the reception of conveyance resistance by the sheet and variations in the conveyance speed, that is, the slowest timing that does not lead to conveyance j am.

Comparative Example

As the comparative example, a case where the sheet S is temporarily stopped (preregistration stop) at the fourth conveyance roller pair 204 before performing the registration of the sheet will be described using FIG. 11. The sheet is conveyed at a constant speed V3 (for example, 1000 mm/s) from the sheet cassette 113, and conveyed to the secondary transfer outer roller 114 in synchronization with the conveyance of the visible image formed on the intermediate transfer belt 106. At this time, the sheet is temporarily stopped at the fourth conveyance roller pair 204. Further, as described above, it is necessary to perform the sheet-present detection for the plurality of times, and, due to the limitations of the sensor, a waiting time is necessary between the sheet-present detections of a first time and a second time. Since, if the time for the sheet-present detection is shortened more than necessary, the detection accuracy of the double feeding detection unit 20 is decreased, it is difficult to shorten the time allocated to the double feeding detecting operation.

While, as described above, so as to perform the double feeding detecting operation highly accurately, it is necessary to allocate a certain amount of time, in this comparative example, the sheet-present detection of the first time is performed during the sheet conveyance, and the sheet-present detection of the second time is performed during the preregistration stop. Since, in the comparative example, the double feeding detecting operation is performed in a timing of the preregistration stop as described above, it is possible to allocate the time for performing the double feeding detecting operation while maintaining the accuracy. However, since the sheet is temporarily stopped in the control of the comparable example including the preregistration stop, it is difficult to realize high productivity. That is, while the double feeding detecting operation needs, for example, 140 ms from a start to the determination of the double feeding detecting operation, it is difficult to secure such length of a stop time so as to realize higher productivity. Further, it is necessary to convey the sheet at a high speed from the sheet cassette 113 to a registration position. However, since, as the conveyance speed becomes faster, time between passages of the leading edge and the trailing edge of the sheet through the double feeding detection unit becomes shorter, it difficult to secure the time for the double feeding detecting operation. Therefore, it is difficult to realize both of the high productivity and the accuracy of the double feeding detection.

Present Embodiment

In contrast, in the sheet conveyance control of the present embodiment, as illustrated in FIG. 10, the sheet is conveyed at the first speed V1 (for example, 1300 mm/s). Then, the sheet is decelerated to the second speed V2 (for example, 800 mm/s) at a deceleration point (in the present embodiment, in a timing in which the first sensor S1 is turned on), and an interrelationship among the conveyance speeds is defined with V1 being larger than V3, and V3 being larger than V2. When the sheet is conveyed at 1300 mm/s, time in which a sheet with a short conveyance length, such as a B5 size sheet (182 millimeters (mm)), passes through the double feeding detection unit 20 becomes 140 ms as a reference. Since the time of about 140 ms is necessary to perform the sheet-present detection twice, taking into consideration such as a delay due to the conveyance efficiency, it is not possible to determine the double feeding during a passage of the sheet through the double feeding detection unit 20. In the present embodiment, so as to enable to determine the double feeding detection during the passage of the sheet through the double feeding detection unit 20 even in a case of the short conveyance length sheet (for example, B5 size), a deceleration control method is applied. To be noted, a specific value of each speed described above is an example, and it is not limited to this. For example, these speeds can be appropriately set based on a conveyance speed in the secondary transfer outer roller 114.

Further, since it is necessary to enable the double feeding detecting operation at the most delayed time in a conveyance delay which occurs at a time of the sheet conveyance, the double feeding detection unit 20 is disposed further downstream in the sheet conveyance direction in comparison with a case of the comparative example. Broken lines in the time chart of FIG. 10 illustrate the double feeding detection in a case where the double feeding detection unit 20 is disposed in a position of the comparative example (position in FIG. 11). Since, by the arrangement of the comparative example, at the most delayed time, the completion timing of the double feeding detection is almost the same as the timing in which the trailing edge of the sheet passes through the double feeding detection unit 20, it is not possible to secure the time for the double feeding detection. In contrast, according to the present embodiment, so as to recover the delay occurred in a section from the sheet cassette 113 to the first to third conveyance roller pairs 201 to 203, it is possible to move the deceleration point of the sheet, on which the conveyance delay has occurred, further downstream than usual. In addition to this, by arranging the double feeding detection unit 20 further downstream in comparison with the case of the comparative example, even in the most delayed case, it is possible to secure the time for the double feeding detection.

That is, based on the timing in which the sheet passes through the first sensor S1, the control unit 103 sets an allowable range R1 in which the timing for the deceleration of the conveyance speed of the sheet from the first speed V1 to the second speed V2 by the sheet conveyance unit 10 can be adjusted. Even in a case where the sheet passes through the first sensor S1 at the most delayed timing in the allowable range R1, the control unit 103 performs the double feeding detecting operation using the double feeding detection unit 20 by decelerating the conveyance speed of the sheet from the first speed V1 to the second speed V2 before the sheet reaches the double feeding detection unit 20.

As described above, according to the image forming apparatus 1 of the present embodiment, by decelerating the conveyance speed of the sheet from the first speed V1 to the second speed V2, the double feeding detecting operation is performed using the double feeding detection unit 20 with respect to the sheet that is conveyed at the second speed V2. Therefore, by optimizations of the deceleration control and the arrangement of the double feeding detection unit 20, it becomes possible to perform the double feeding detecting operation while maintaining the high productivity without stopping the sheet, and possible to realize both of the productivity and the accuracy of the double feeding detection.

Further, according to the image forming apparatus 1 of the present embodiment, at the most delayed time of the sheet conveyance, the double feeding detecting operation is performed after the sheet conveyance speed has been decelerated to the second speed V2. Therefore, it is possible to realize both of the productivity and the accuracy of the double feeding detection.

To be noted, while, in the embodiment described above, a case where the sheet conveyance unit 10 is disposed between the sheet cassette 113 and the secondary transfer outer roller 114 is described, it is not limited to this, and it is acceptable to arrange the sheet conveyance unit 10 in other positions. Further, while the ultrasonic sensor is used as the sensor used in the double feeding detection unit 20, it is not limited to this, and it is acceptable to use other types of sensors.

According to this disclosure, it is possible to realize both of the productivity and the accuracy of the double feeding detection.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-180328, filed Nov. 10, 2022 which is hereby incorporated by reference herein in its entirety.

What is claimed is:

1. A sheet conveyance apparatus comprising:

a sheet conveyance unit configured to convey a sheet;

a double feeding detection unit configured to detect double feeding with respect to a sheet conveyed by the sheet conveyance unit;

a first sheet detection unit configured to detect a sheet conveyed by the sheet conveyance unit; and a control unit configured to control a conveyance speed of a sheet conveyed by the sheet conveyance unit at a first speed and a second speed which is slower than the first speed and at which the sheet is in motion, wherein the control unit is configured to control the sheet conveyance unit to decelerate the conveyance speed of a sheet conveyed by the sheet conveyance unit from the first speed to the second speed based on a detection result of the first sheet detection unit, and control the double feeding detection unit to execute a double feeding detecting operation with respect to the sheet that is conveyed at the second speed by the sheet conveyance unit.

2. The sheet conveyance apparatus according to claim 1, wherein the control unit is configured to control the double feeding detection unit so as to execute the double feeding detecting operation for a plurality of times for a single sheet.

3. The sheet conveyance apparatus according to claim 2, wherein the plurality of times are two times.

4. The sheet conveyance apparatus according to claim 1, wherein the first sheet detection unit is disposed upstream of the double feeding detection unit in a sheet conveyance direction, and wherein the control unit is configured to set an allowable range for a timing in which the sheet passes through the first sheet detection unit, the allowable range being a range in which an adjustment of a timing of decelerating the conveyance speed of the sheet conveyed by the sheet conveyance unit from the first speed to the second speed is allowed.

5. The sheet conveyance apparatus according to claim 1, further comprising:

a second sheet detection unit disposed upstream of the double feeding detection unit and downstream of the first sheet detection unit in a sheet conveyance direction, and configured to detect a sheet conveyed by the sheet conveyance unit, wherein, based on a detection result of the second sheet detection unit, the control unit is configured to control the double feeding detection unit to execute the double feeding detecting operation with respect to the sheet conveyed by the sheet conveyance unit.

6. The sheet conveyance apparatus according to claim 1, wherein the control unit is configured to control the double feeding detection unit to execute the double feeding detecting operation before a sheet reaches the double feeding detection unit so as to acquire a detection result in a state where a sheet is not present.

7. The sheet conveyance apparatus according to claim 1, wherein the double feeding detection unit includes an ultrasonic sensor.

8. An image forming apparatus comprising:

the sheet conveyance apparatus according to claim 1; and an image forming unit configured to form an image on a sheet conveyed by the sheet conveyance apparatus.

* * * * *